United States Patent [19]

Shamsid-Deen

[11] Patent Number: 4,478,417

[45] Date of Patent: Oct. 23, 1984

[54] HOLDER FOR GAME PIECES

[76] Inventor: John T. Shamsid-Deen, 11815 Christopher Ave., Inglewood, Calif. 90303

[21] Appl. No.: 481,474

[22] Filed: Apr. 1, 1983

[51] Int. Cl.[3] ..... A63F 1/10; A63F 9/20

[52] U.S. Cl. ..... 273/150; 273/295; 273/DIG. 30; 294/1 R

[58] Field of Search ..... 273/150, 295, DIG. 30, 273/239, 346, 148 R; 294/1.1, 65.5

[56] References Cited

U.S. PATENT DOCUMENTS

| | | | |
|---|---|---|---|
| 2,600,951 | 6/1952 | Edwards | 273/295 |
| 2,970,003 | 1/1961 | Heath, Jr. et al. | 273/148 R |
| 3,277,589 | 10/1966 | Berdan et al. | 434/224 |
| 3,316,669 | 5/1967 | Nachbar | 273/DIG. 30 X |
| 3,921,983 | 11/1975 | Taylor | 273/148 R |
| 3,975,813 | 8/1976 | Bell | 294/65.5 X |

*Primary Examiner*—Anton O. Oechsle
*Attorney, Agent, or Firm*—Wm. Jacquet Gribble

[57] ABSTRACT

A holder assembly has strips of contact engaging material on the backs of the playing pieces and compatible strips of contact engaging strips on an obverse face of a piece holder adapted to rest upon a planar support. A hand grip protrudes from the reverse face of the piece holder. The grip is contoured to afford an easy grip to a player, especially those handicapped by arthritis or other hand crippling diseases. The grip is oblong and its long axis is at an angle to the lower edge of the holder, which seats on the planar support. The grip has opposed ends and the lower end is spaced from the lower holder edge so that it acts as a leg to support the holder at an angle to the support surface for better visibility of the playing pieces secured removeably to the holder by the contact between the engaging material strips on the pieces and on the holder. The pieces may be laid face down on the support and the holder then pressed upon them to be erected with the pieces in order in front of the player.

3 Claims, 11 Drawing Figures

HOLDER FOR GAME PIECES

BACKGROUND OF THE INVENTION

The invention relates to holders for small game playing pieces such as those used in dominoes, tile rummy and other similar games. Such pieces are not easy to manipulate with the currently used racks or boxes and sacks, and are particularly difficult for those afflicted with crippling conditions of the hands to handle, having an adverse effect upon the enjoyment of the games. While the present game equipment is adequate, many persons are inhibited from playing because of the collapse of racks, the falling of personal pieces from place with the subsequent revelation to other players of the contents of another's hand, and the delay of the game flow by the needed re-structuring of the order of pieces after a spill.

Others have recognized the problems as set forth above, and a preliminary examination has disclosed the following prior U.S. Pat. Nos.: 3,327,419 issued June 27, 1967 to P. P. Stanos; 3,316,669 issued May 2, 1967 to E. G. Nachbar; 3,880,429 issued Apr. 29, 1975 to J. M. Blumenaus; 4,226,420 issued Oct. 7, 1980 to D. L. Corday; 4,303,247 issued Dec. 1, 1981 to D. A. Fain.

While some of these prior patents suggest the use of contact engaging material strips or bands, such ones of "Velcro", none discloses apparatus with the distinctive elements and advantages of the instant invention.

SUMMARY OF THE INVENTION

The invention contemplates a holder assembly for small, flat game pieces normally rested upon a planar support, like a table top, and comprises a plurality of game pieces each having one face with game indicia thereon and an opposite plain face with contact engaging material thereon adapted to engage compatible contact engaging material on a piece holder with a planar holder plate to receive the engaging material and a grip protruding from the back of the holder plate. The plate is preferably a thin rectangular element with contact engaging material on an obverse face and the grip on the reverse face. A holder plate lower edge is adapted to rest on the planar support while a grip end point displaced from the lower edge affords an easel aspect to the holder so that the obverse face thereof inclines from the vertical. The grip is oblong and its long axis is at an acute angle to the lower plate edge. One end of the grip is larger than the other to aid in holding the holder assembly at an angle to the player if desired. The playing pieces may be arranged as desired upon the planar support and then the holder plate is applied to the backs of the pieces so that the compatible contact engaging strips mesh, the entire set of playing pieces than being maneuvered to the desired position, either in the hand or upon the support.

The materials of the holder plate may vary, with "Plexiglas" being presently preferred because of its beauty, workability and availability. While the holder plate and grip are joined by solvent welding, the holder plate and grip may be molded in one piece.

These and other advantages of the invention are apparent from following detailed description and drawing.

BRIEF DESCRIPTION OF THE DRAWING

In the various Figures like reference numbers are used to identify like elements.

DESCRIPTION OF THE PREFERRED EMBODIMENTS

Figure 1:
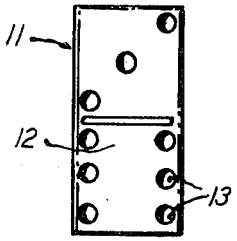
FIG. 1 is a front elevational view of a domino playing piece.
Figure 2:
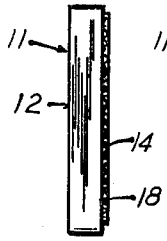
FIG. 2 is a side elevational view of the piece of FIG. 1.
Figure 3:
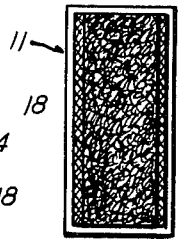
FIG. 3 is a rear elevational view of the piece of FIG. 1.
Figure 4:
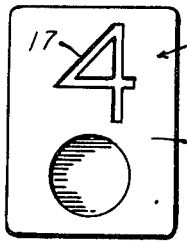
FIG. 4 is a front elevational view of a rummy tile piece.
Figure 5:
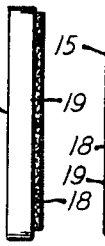
FIG. 5 is a side elevational view of the piece of FIG. 4.
Figure 6:
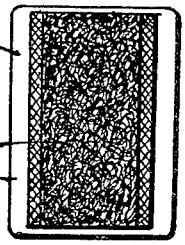
FIG. 6 is a rear elevational view of the piece of FIG. 4.

FIGS. 1 through 6 show different aspects of two playing piece types, FIGS. 1–3 being of a domino and FIGS. 4–6 being of a rummy tile. The domino is shown to reduced scale while the tile is approximately full scale. Domino 11 has a front face 12 with game indicia 13 thereon. Tile 15 has a front face 16 with indicia 17 thereon. Each piece has a strip 18 of a first hook and loop contact engaging material on the respective rear faces 14, 19, the rear faces being otherwise plain.

Figure 7:
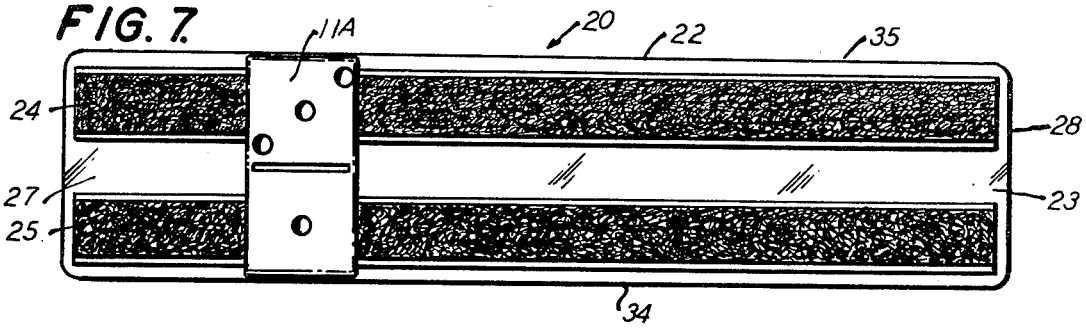
FIG. 7 is a front elevational view of the holder assembly of the invention, showing a holder plate and playing piece.

FIG. 7 shows a holder assembly 20 comprised of a planar holder plate 22, rectangular in shape and preferably made of a thin element of "Plexiglas" or like transparent or translucent plastic. An obverse face 23 of the plate has parallel strips 24, 25 of contact engaging material similar to the hook and loop fasteners sold under the trademark "Velcro" extending between opposite sides 27, 28 of the plate. Strips 24, 25 are compatible with the strips 18 on the rear faces of the playing pieces 11 and 15, so that the strips engage when in contact to hold the pieces to the holder plate, like piece 11A is engaged in FIG. 7. It is obvious that a number of pieces are engageable with the holder plate, as can be seen from FIG. 8. A row of dominoes 11 are lying in desired arrangement upon a support 30. The support is preferably planar to accommodate both pieces or playing board, depending upon the nature of the game. A hand grip 32 is fixed to the reverse face of the holder plate 22 of assembly 20 to facilitate maneuvering the holder plate. The grip 32 protrudes from the reverse face to afford a handle graspable by normal or handicapped fingers.

Figure 9:
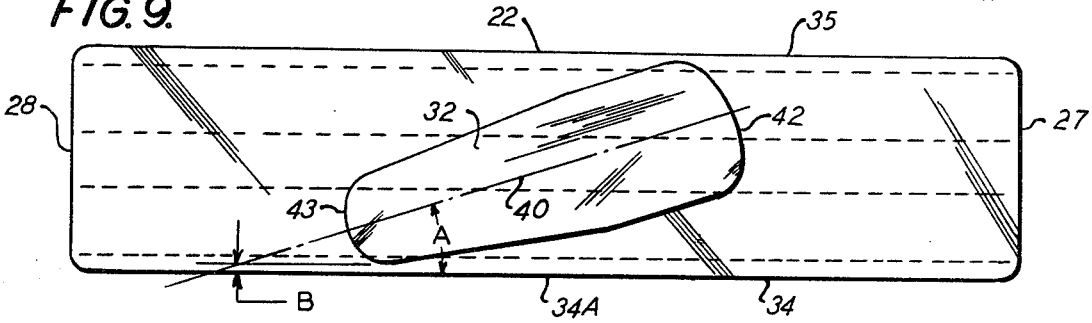
FIG. 9 is a rear elevational view of the holder plate of FIG. 7.

Facility to maneuver the holder assembly is aided by the configuration and attitude of the grip. A holder plate lower edge 34 has a planar surface 34A visible in FIG. 10, resting on the support. A parallel plate edge 35 defines the upper boundary of the plate, extending between sides 27, 28 of the holder plate. The hand grip has an elongate axis shown as a broken line 40 in FIG. 9. The axis extends at an angle "A" to the plate lower edge 34 to help a player to maintain the proper attitude of the plate holder when flexibility of wrist or fingers is limited. Additionally, the opposite ends of the essentially oblong grip are rounded for comfort, the end 42 closer to holder upper edge 35 being larger to fit the hand between thumb base and little finger. The grip tapers a little to smaller end 43, which is spaced upwardly from plate lower edge 34 a distance indicated by dimension "B" in FIG. 9.

Figure 8:
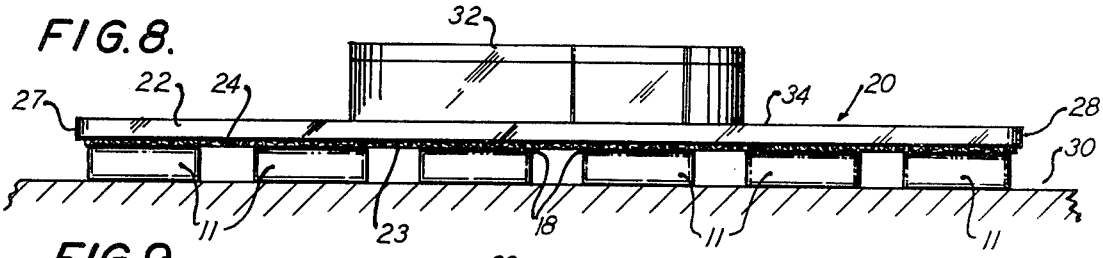
FIG. 8 is a side elevational view of the assembly of the invention in position to pick up playing pieces.
Figure 10:
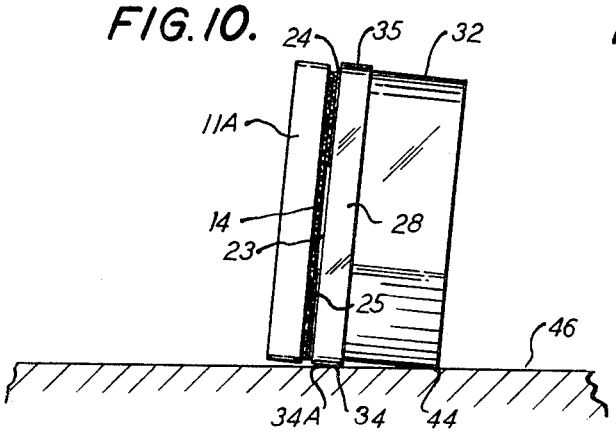
FIG. 10 is a right end elevational view of the holder assembly of FIG. 7.

The offset of the end 43 is needed to achieve a slant to the holder assembly on the support once the pieces in their proper or desired order are picked up from the support as shown in FIG. 8. A point 44 of the grip end 43 is shown in FIG. 10 in contact with the support surface 46. "Point" is used here in the sense of small area rather than referring to sharpness. Since point 44 is displaced from edge 34 and surface 34A, the obverse face 23 is sloped away from the player to aid visibility as well as balance, although a tipped over holder assembly in accordance with the invention does not disturb the arrangement of the playing pieces.

The invention therefore is seen to provide an easily comprehended device for aiding all players in quick, accurate assembly of playing pieces in good order with the pieces being maintained in order until removed from the holder as desired.

Figure 11:
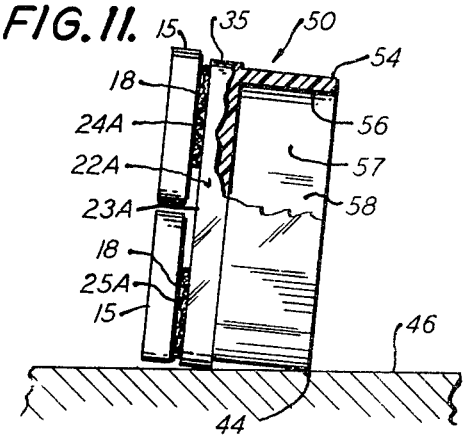
FIG. 11 is a right side elevational view similar to FIG. 10 of an alternate embodiment of the invention.

An alternate embodiment of the invention affording the same benefits is shown in partial section in FIG. 11. A game piece holder assembly 50 has a holder plate similar to that of FIG. 7 and strips 24A, 25A of contact engaging material on its obverse face 23A. Rummy tiles like the tiles 15, with contact engaging strips 18 on the rear faces thereof, are engaged with the holder plate 22A. A hand grip 54 similar in outer configuration to the grip 32 of the previously described embodiment is integrally formed by molding with the holder plate 22A of the embodiment of FIG. 11. Inner grip walls 56, 57 define the hollow 58 of the grip, and may afford a finger recess for those unable to grip firmly the smooth outer wall of the grip.

Either embodiment is capable of mass production by conventional fabrication techniques from materials readily available from commercial suppliers. If molded the die costs are minimal, while manufacture from sheet materials can be done by most craftsmen.

While the foregoing description has illustrated the invention with two embodiments, many other embodiments will occur to those skilled in this art within the scope of the invention. It is therefore desired that the measure of the invention be the appended claims rather than the merely illustrative disclosure made herein.

I claim:

1. A game piece holder assembly to be rested upon a planar support and comprising a multiplicity of flat game pieces each having an indicia face with game indicia thereon and an opposite plain face, a strip of first contact engaging material on said flat plain face, a planar holder plate, at least one strip of a second contact engaging material on an obverse face of said holder plate adapted to receive the first contact engaging material strip of each of said game pieces to hold the pieces to the obverse face of the holder plate, said plate having opposite holder plate upper and lower edges; an oblong hand grip with a long axis between first and second ends of said oblong hand grip, means fixing said hand grip to the reverse face of said holder plate, said hand grip being secured to said reverse plate face such that the long axis thereof is parallel to the plane of the plate and is at an acute angle to said holder plate lower edge, a first end of said oblong hand grip being adjacent said holder plate lower edge, in position to rest upon said planar support.

2. A game piece holder assembly in accordance with claim 1 wherein said hand grip projects from said reverse plate face such that a point of said grip end remote from said reverse plate face is displaced from the plane of said holder plate lower edge such that the obverse face of said holder plate cants with respect to said support surface when said holder assembly rests on said support.

3. A game piece holder assembly in accordance with claim 1 wherein each of said first and second ends is rounded, said second end being greater in extent transversely of said long axis than said first end.

* * * * *